US006153086A

United States Patent [19]

Gupta et al.

[11] Patent Number: 6,153,086

[45] Date of Patent: Nov. 28, 2000

[54] COMBINATION COCURRENT AND COUNTERCURRENT STAGED HYDROPROCESSING WITH A VAPOR STAGE

[75] Inventors: Ramesh Gupta, Berkeley Heights; Henry Jung, Chatham Borough, both of N.J.; Edward S. Ellis, Fairfax, Va.; James J. Schorfheide, Baton Rouge, La.; Larry L. Iaccino, Friendwoods, Tex.

[73] Assignee: Exxon Research and Engineering Company, Florham Park, N.J.

[21] Appl. No.: 09/073,414

[22] Filed: May 6, 1998

Related U.S. Application Data

[63] Continuation-in-part of application No. 08/701,927, Aug. 23, 1996, Pat. No. 5,906,728.

[51] Int. Cl.[7] ..... C10G 65/00

[52] U.S. Cl. ..... 208/59; 208/61; 208/89; 208/57; 208/60; 208/62; 208/66; 208/107

[58] Field of Search ..... 208/61, 89, 57, 208/60, 62, 66, 107, 59

[56] References Cited

U.S. PATENT DOCUMENTS

| | | | |
|---|---|---|---|
| 2,952,626 | 9/1960 | Kelley et al. | 208/210 |
| 2,987,467 | 6/1961 | Keith et al. | 208/97 |
| 3,017,345 | 1/1962 | Eastman et al. | 208/210 |
| 3,228,871 | 1/1966 | Schlinger | 208/58 |
| 3,788,976 | 1/1974 | Kirk et al. | 208/89 |
| 3,905,893 | 9/1975 | Christman et al. | 208/210 |
| 4,021,330 | 5/1977 | Satchell | 208/89 |
| 4,212,726 | 7/1980 | Mayes | 208/101 |
| 4,244,519 | 1/1981 | Schorfheide | 208/210 |
| 4,457,834 | 7/1984 | Caspers et al. | 208/143 |
| 4,591,426 | 5/1986 | Krasuk et al. | 208/96 |
| 4,801,373 | 1/1989 | Corman et al. | 208/210 |
| 5,082,551 | 1/1992 | Reynolds et al. | 208/100 |
| 5,292,428 | 3/1994 | Harrison et al. | 208/208 R |
| 5,348,641 | 9/1994 | Shih | 208/89 |
| 5,670,116 | 9/1997 | Gupta et al. | 422/191 |
| 5,705,052 | 1/1998 | Gupta | 208/57 |
| 5,720,872 | 2/1998 | Gupta | 208/57 |
| 5,779,992 | 7/1998 | Higashi | 422/190 |
| 5,888,377 | 3/1999 | Bertram | 208/59 |
| 5,906,728 | 5/1999 | Iaccino et al. | 208/61 |
| 5,925,235 | 7/1999 | Habib | 208/111.35 |

*Primary Examiner*—Walter D. Griffin
*Assistant Examiner*—Nadine Preisch
*Attorney, Agent, or Firm*—Henry E. Naylor; Gerard J. Hughes

[57] ABSTRACT

A hydroprocessing process includes a cocurrent flow liquid reaction stage, a countercurrent flow liquid reaction stage and a vapor reaction stage in which feed components are catalytically hydroprocessed by reacting with hydrogen. Both liquid stages both produce a liquid and a vapor effluent, with the cocurrent stage liquid effluent the feed for the countercurrent stage and the countercurrent stage liquid effluent the hydroprocessed product liquid. Both liquid stage vapor effluents are combined and catalytically reacted with hydrogen in a vapor reaction stage, to form a hydroprocessed vapor. This vapor is cooled to condense and recover a portion of the hydroprocessed hydrocarbonaceous vapor components as additional product liquid. The uncondensed vapor is rich in hydrogen and is cleaned up if necessary, to remove contaminants, and then recycled back into the cocurrent stage as hydrogen-containing treat gas. Fresh hydrogen is introduced into the countercurrent stage and the countercurrent stage effluent contains sufficient, and preferably all of the hydrogen for the vapor stage reaction.

15 Claims, 1 Drawing Sheet

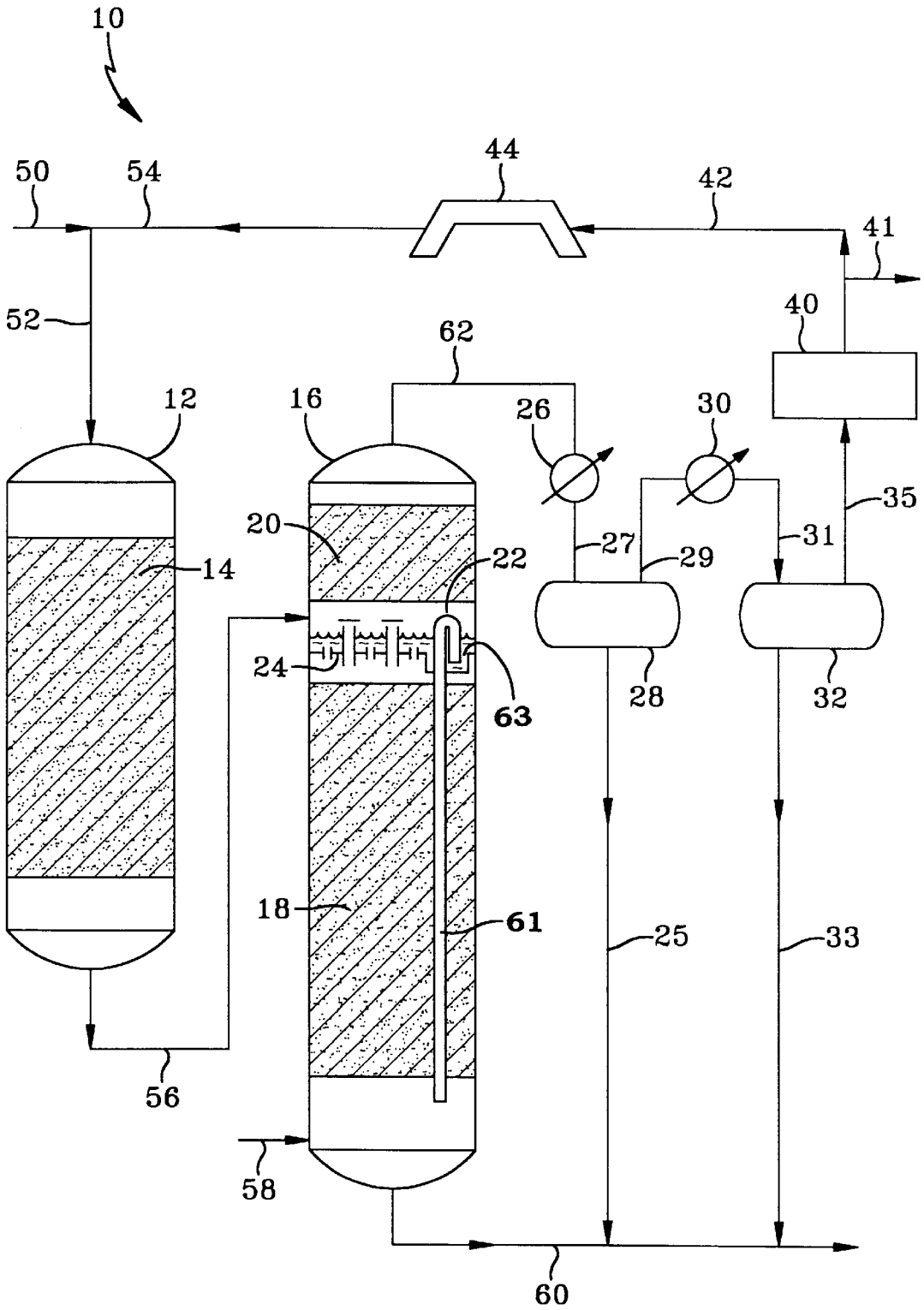
10
50
54
44
42
41
52
40
62
12
16
26
30
35
20
27
29
31
14
22
24
63
28
32
18
61
25
33
56
58
60

COMBINATION COCURRENT AND COUNTERCURRENT STAGED HYDROPROCESSING WITH A VAPOR STAGE

CROSS REFERENCE TO RELATED APPLICATIONS

This is a continuation-in-part of U.S. Ser. No. 08/701,927 filed Aug. 23, 1996, U.S. Pat. No. 5,906,728.

BACKGROUND OF THE DISCLOSURE

1. Field of the Invention

The present invention relates to hydroprocessing hydrocarbonaceous feeds using a combination of cocurrent and countercurrent liquid hydroprocessing stages and one vapor hydroprocessing reaction stage. More particularly the invention relates to catalytically hydroprocessing a hydrocarbonaceous feed in a first liquid reaction stage in which the feed and treat gas flow cocurrently to produce a liquid and vapor effluent which are separated, with the liquid then hydroprocessed in a second stage flowing countercurrently to the treat gas to produce a hydroprocessed product liquid at the bottom of the second stage and a vapor effluent at the top, with both vapor effluents combined and hydroprocessed in a vapor stage.

2. Background of the Invention

As supplies of lighter and cleaner feeds dwindle, the petroleum industry will need to rely more heavily on relatively high boiling feeds derived from such materials as coal, tar sands, shale oil, and heavy crudes, all of which typically contain significantly more undesirable components, especially from an environmental point of view. These components include halides, metals, unsaturates and heteroatoms such as sulfur, nitrogen, and oxygen. Furthermore, due to environmental concerns, specifications for fuels, lubricants, and chemical products, with respect to such undesirable components, are continually becoming tighter. Consequently, such feeds and product streams require more upgrading in order to reduce the content of such undesirable components and this increases the cost of the finished products.

In a hydroprocessing process, at least a portion of the heteroatom compounds are removed, the molecular structure of the feed is changed, or both occur by reacting the feed with hydrogen in the presence of a suitable hydroprocessing catalyst. Hydroprocessing includes hydrogenation, hydrocracking, hydrotreating, hydroisomerization and hydrodewaxing, and therefore plays an important role in upgrading petroleum streams to meet more stringent quality requirements. For example, there is an increasing demand for improved heteroatom removal, aromatic saturation, and boiling point reduction. In order to achieve these goals more economically, various process configurations have been developed, including the use of multiple hydroprocessing stages as is disclosed, for example, in European patent publication 0 553 920 A1 and U.S. Pat. Nos. 2,952,626; 4,021,330; 4,243,519; 4,801,373 and 5,292,428.

SUMMARY OF THE INVENTION

The invention relates to a process for hydroprocessing a hydrocarbonaceous feed in which the feed is reacted with hydrogen in the presence of a hydroprocessing catalyst in a cocurrent flow liquid reaction stage to produce a vapor and a liquid effluent which are separated, with the liquid effluent further hydroprocessed by reacting with countercurrent flowing hydrogen in a countercurrent flow liquid reaction stage to produce a hydroprocessed product liquid at the bottom of the countercurrent stage and a vapor effluent at the top, with both vapor effluents combined and hydroprocessed in a vapor hydroprocessing stage to produce hydroprocessed vapor. Fresh hydrogen or a treat gas comprising hydrogen is used for both liquid stages. The hydrogen for the vapor stage reaction may be fresh hydrogen, unreacted hydrogen in the vapor effluents or both. It is preferred that all or at least a portion of the vapor stage reaction hydrogen be provided by unreacted hydrogen in the combined vapor effluent from the two liquid stages. The hydroprocessed vapor comprises hydroprocessed hydrocarbonaceous feed material, at least a portion of which (e.g., $C_{4+}$–$C_{5+}$ material) may be recovered as additional product liquid by cooling. If the remaining uncondensed vapor is rich in hydrogen, after being cleaned up to remove any contaminants present, it may be used as fresh treat gas to provide all or a portion of the hydrogen for the cocurrent or countercurrent liquid reaction stages. Sufficient fresh hydrogen or hydrogen-containing treat gas is introduced into either or both the cocurrent and countercurrent stages to insure that the combined vapor effluents contain sufficient hydrogen (unreacted hydrogen) to provide at least a portion or all of the hydrogen required for the vapor stage hydroprocessing. The term "hydrogen" as used herein refers to hydrogen gas. More particularly the invention comprises a hydroprocessing process which includes two liquid and one vapor reaction stages and which comprises the steps of:

(a) reacting a feed comprising a hydrocarbonaceous liquid with hydrogen in a cocurrent flow reaction stage in the presence of a hydroprocessing catalyst to form a first stage effluent comprising a mixture of partially hydroprocessed hydrocarbonaceous liquid and vapor;

(b) separating said liquid and vapor effluent;

(c) reacting said first stage liquid effluent with hydrogen in the presence of a hydroprocessing catalyst in a countercurrent flow hydroprocessing reaction stage to produce a hydroprocessed hydrocarbonaceous product liquid effluent at the bottom of said stage and a hydrocarbonaceous vapor effluent at the top, and (d) combining both of said vapor effluents and reacting them with hydrogen in the presence of a hydroprocessing catalyst in a vapor hydroprocessing reaction stage to produce a hydroprocessed hydrocarbonaceous vapor, wherein at least a portion of said vapor stage reaction hydrogen is provided by unreacted hydrogen at least one of said countercurrent or cocurrent reaction stage vapor effluents.

The hydroprocessed vapor may then be cooled to condense the higher boiling hydroprocessed hydrocarbonaceous material present in the vapor as additional product liquid which is separated from the remaining uncondensed vapor by any suitable means, such as a simple drum separator. The uncondensed vapor will comprise the lighter hydrocarbonaceous material (e.g., ~$C_{4-}$–$C_{5-}$), depending on the temperature and pressure), unreacted hydrogen, gaseous contaminants, and hydrogen treat gas diluent, if present. Further, using a cocurrent stage at a sufficiently higher pressure than the countercurrent stage eliminates the need for a hot liquid pump for passing the cocurrent liquid effluent to the countercurrent stage.

In one embodiment, sufficient hydrogen for the vapor stage reaction will be present in the combined vapor effluents from both the cocurrent and countercurrent stages. In a preferred embodiment, there will be a sufficient concentration of unreacted hydrogen in the countercurrent vapor stage effluent to completely hydroprocess the combined vapor effluents in the vapor stage. In a yet further embodiment, there will be sufficient unreacted hydrogen remaining in the hydroprocessed vapor effluent from the vapor reaction stage treat gas, to provide at least a portion of the hydrogen required for at least one or both of the cocurrent or countercurrent stage hydroprocessing, as shown in the FIGURE and described in detail below. The process of the invention is particularly useful for hydroprocessing hydrocarbons to remove undesirable contaminants. An example is hydrotreating a hydrocarbon fraction to remove sulfur and nitrogen. In this process, the sulfur and nitrogen compounds in the feed liquid are converted to $H_2S$ and $NH_3$ which pass into the vapors, along with vaporized hydrocarbons and gaseous hydrocarbons, such as methane. Because of the simple flash separation between the liquid and vapor effluents in the two liquid stages, the vapor phase contains some sulfur and nitrogen containing hydrocarbon material which is hydroprocessed in the vapor stage. Cooling the treated vapor and condensing the heavier hydrotreated hydrocarbons permits recovery of the additional hydrotreated product liquid. If the remaining vapor contains sufficient unreacted hydrogen, the $H_2S$ and $NH_3$ contaminants may be stripped out by any known means, such as amine scrubbing, and the remaining, hydrogen-rich vapor used as part of the cocurrent stage or countercurrent stage treat gas. The countercurrent and vapor reaction stages may be in the same reaction vessel or in separate vessels. The catalyst used in each stage may be the same or different, depending on the feed and the process objectives. In some cases fresh hydrogen or a hydrogen-containing treat gas may be passed into either or both the cocurrent and vapor stages.

In the practice of the invention, the fresh hydrocarbonaceous feed fed into the cocurrent stage reaction zone is mostly liquid and typically completely liquid. During the hydroprocessing, at least a portion of the lighter or lower boiling feed components are vaporized in each liquid stage. The amount of feed vaporization will depend on the nature of the feed and the temperature and pressure in the reaction stages and may range between about 5–80 wt. %. Thus, by liquid reaction stage is meant that some of the feed being hydroprocessed is in the liquid state. In most cases the hydrocarbonaceous feed will comprise hydrocarbons.

BRIEF DESCRIPTION OF THE DRAWING

The FIGURE schematically illustrates an embodiment of the invention in which the countercurrent and vapor hydroprocessing stages are in a single reaction vessel.

DETAILED DESCRIPTION

By hydroprocessing is meant a process in which hydrogen reacts with a hydrocarbonaceous feed to remove one or more heteroatom impurities such as sulfur, nitrogen, and oxygen, to change or convert the molecular structure of at least a portion of the feed, or both. Non-limiting examples of hydroprocessing processes which can be practiced by the present invention include forming lower boiling fractions from light and heavy feeds by hydrocracking; hydrogenating aromatics and other unsaturates; hydroisomerization and/or catalytic dewaxing of waxes and waxy feeds, and demetallation of heavy streams. Ring-opening, particularly of naphthenic rings, can also be considered a hydroprocessing process. By hydrocarbonaceous feed is meant a primarily hydrocarbon material obtained or derived from crude petroleum oil, from tar sands, from coal liquefaction, shale oil and hydrocarbon synthesis. The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig.

Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction and hydrocarbons synthesized from a mixture of $H_2$ and CO via a Fischer-Tropsch type of hydrocarbon synthesis.

For purposes of hydroprocessing and in the context of the invention, the terms "fresh hydrogen" and "hydrogen-containing treat gas" are synonymous and may be either pure hydrogen or a hydrogen-containing treat gas which is a treat gas stream containing hydrogen in an amount at least sufficient for the intended reaction plus other gas or gasses (e.g., nitrogen and light hydrocarbons such as methane) which will not adversely interfere with or affect either the reactions or the products. These terms exclude recycled vapor effluent from another stage which has not been processed to remove contaminants and at least a portion of any hydrocarbonaceous vapors present. They are meant to include either hydrogen or a hydrogen-containing gas from any convenient source, including the hydrogen-containing gas comprising unreacted hydrogen recovered from hydroprocessed vapor effluent, after first removing at least a portion and preferably most of the hydrocarbons (e.g., $C_{4+}$–$C_{5+}$) or hydrocarbonaceous material and any contaminants (e.g., $H_2S$ and $NH_3$) from the vapor, to produce a clean, hydrogen rich treat gas. The treat gas stream introduced into a reaction stage will preferably contain at least about 50 vol. %, more preferably at least about 75 vol. % hydrogen. In operations in which unreacted hydrogen in the vapor effluent of any particular stage is used for hydroprocessing in a subsequent stage or stages, there must be sufficient hydrogen present in the fresh hydrogen or hydrogen-containing treat gas introduced into that stage for the vapor effluent of that stage to contain sufficient hydrogen for the subsequent stage or stages.

In the embodiment shown in the FIGURE, the hydroprocessing process is a hydrotreating process and the reaction stages hydrotreating stages. Referring to the FIGURE, a hydrotreating unit 10 comprises a cocurrent liquid reaction stage, downflow reaction vessel 12 containing a catalyst bed 14 within, and a reaction vessel 16 containing a countercurrent liquid reaction stage defined by catalyst bed 18, above which is a vapor reaction stage defined by catalyst bed 20. Flash space or zone 22 permits the mixed vapor and liquid effluent from 12 to separate and vapor-liquid separation means 24 permits the separated liquid from 12 to be distributed over the catalyst bed 18 below and, at the same time, permit the hydrogen-containing vapor produced in the countercurrent stage to be swept up and out of bed 18 and into the vapor reaction stage 20. Also shown are hot and cold heat exchangers 26 and 30, along with attendant hot and cold simple drum type vapor-liquid separators 28 and 32 for cooling and condensing the heavier hydrotreated vapors, amine scrubber 40 and compressor 44. Not shown is one or more simple strippers for stripping any dissolved $H_2S$ and $NH_3$ from the product liquid and condensed vapor. The hydrocarbon feed to be hydrotreated is passed via lines 50 and 52 into vessel 12 and down onto, across and through the catalyst bed 14 below. In this particular illustration of the invention, the feed is a petroleum derived distillate or diesel fuel fraction containing heteroatom compounds of sulfur, nitrogen and perhaps oxygen. Treat gas comprising hydrogen is passed into the top of vessel 12 via lines 54 and 52, and passes cocurrently down through the catalyst bed with the feed which reacts with the hydrogen in the presence of the hydrotreating catalyst to remove most of the heteroatom impurities from the liquid as gases including, for example, $H_2S$, $NH_3$ and water vapor, as well as forming lighter hydrocarbons. At the same time some of the heteroatom-containing feed liquid is vaporized. Most of the sulfur and other heteroatom compounds are removed from the feed in this stage. By most is meant over 50% which could be 60%, 75% and even ≧80%. Therefore, the subsequent countercurrent stage catalyst can be less sulfur tolerant, but more active for heteroatom removal, and also an aromatics saturation catalyst which, for the sake of illustration in this embodiment, may comprise nickel-molybdenum or nickel-tungsten catalytic metal components on an alumina support. The mixed liquid and vapor effluent is passed via line 56 into flash zone 22 in vessel 16 in which the vapor separates from the liquid. The mostly hydroprocessed liquid is passed down through tray 24 across and down through the catalyst bed 18 below. The downflowing liquid mixes and reacts, in the presence of the catalyst, with the upflowing hydrogen or hydrogen-containing treat gas introduced, via line 58, into vessel 16 below catalyst bed 18. This produces a hydrotreated product liquid effluent which is withdrawn from the bottom of the vessel via line 60. The heteroatoms removed are similar to those in the cocurrent stage and the vapor produced in 18 is similar, but with significantly less heteroatom contaminated compounds. This vapor also contains unreacted hydrogen from the hydrogen introduced via line 58. The countercurrent vapor passes up through the bed 18, through and above means 24 where it mixes with the vapors from vessel 12. Not all of the vapor effluent from the countercurrent stage is hydrotreated or hydrotreated to the same extent as would occur in a cocurrent flow stage. The hydrogen-containing, combined vapor stream then passes up through the vapor reaction stage indicated by catalyst bed 20 in which the hydrogen reacts with the hydrocarbon vapors to remove heteroatom compounds. These hydrotreated vapors are removed from the vessel via line 62 and passed to heat exchanger 26 in which they are cooled down to a temperature typically in the range of 400–600° F. to condense out the higher boiling hydrocarbons in the vapor as liquid, which is separated from the remaining vapor in drum separator 28. The remaining vapor is passed to heat exchanger 30 via line 29 in which it is further cooled down to a temperature of about 100° F. to condense out more hydrocarbons. The use of hot and cold separators permits better overall separation than if only a single separator is used. The liquid-vapor mixture produced in 30 is passed into another drum separator 32 via line 31 to separate the additional liquid from the remaining vapor. The liquids removed from 28 and 32 are respectively passed via lines 25 and 33 to liquid product line 60 as additional product liquid. The remaining vapor which now comprises a mixture of unreacted hydrogen, light (e.g., $C_{4-}$–$C_{5-}$) hydrocarbons, $H_2S$ and $NH_3$ is passed via line 35 into a scrubber in which it is scrubbed with an aqueous amine solution to remove the $H_2S$ and $NH_3$ to produce a clean, hydrogen-rich gas. This clean, hydrogen-containing gas which is now a treat gas, is passed via line 42 into compressor 44 and from there into the cocurrent first liquid stage reactor via lines 54 and 52. This gas can also be passed into the countercurrent stage via line 58. Also shown in this embodiment is a self-regulating vapor bypass tube 61, which is a hollow tube or conduit open at both ends with the upper portion curved over and down and terminating in a liquid well 63 in tray 24 as shown. This serves to prevent flooding of catalyst bed 18 in the event the pressure or flow rate of the upward and countercurrently flowing hydrogen or treat gas becomes too great. The liquid head in the well over the opening in the upper portion of the tube acts as a pressure relief.

Those skilled in the art will appreciate that the invention can be extended to more than two liquid and one vapor stages. Thus, one may also employ three or more liquid stages in which the partially processed liquid effluent from the first stage is the second stage feed, the second stage liquid effluent is the third stage feed, and so on, with attendant vapor stage processing in one or more vapor reaction stages. By reaction stage is meant at least one catalytic reaction zone in which the liquid, vapor or mixture thereof reacts with hydrogen in the presence of a suitable hydroprocessing catalyst to produce an at least partially hydroprocessed effluent. The catalyst in a reaction zone can be in the form of a fixed bed, a fluidized bed or dispersed in a slurry liquid. More than one catalyst can also be employed in a particular zone as a mixture or in the form of layers (for a fixed bed). Further, where fixed beds are employed, more than one bed of the same or different catalyst may be used, so that there will be more than one reaction zone. The beds may be spaced apart with optional gas and liquid distribution means upstream of each bed, or one bed of two or more separate catalysts may be used in which each catalyst is in the form of a layer, with little or no spacing between the layers. The hydrogen and liquid will pass successively from zone to the next. The hydrocarbonaceous material and hydrogen or treat gas are introduced at the same or opposite ends of the stage and the liquid and/or vapor effluent removed from a respective end.

The term "hydrotreating" as used herein refers to processes wherein a hydrogen-containing treat gas is used in the presence of a suitable catalyst which is primarily active for the removal of heteroatoms, such as sulfur, and nitrogen, non-aromatics saturation and, optionally, saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. As mentioned above, it is within the scope of the present invention that more than one type of hydrotreating catalyst may be used in the same reaction stage or zone. Typical hydrotreating temperatures range from about 100° C. to about 400° C. with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatic hydrogenation catalysts include nickel, cobalt-molybdenum, nickel-molybdenum, and nickel-tungsten. Noble metal (e.g., platinum and/or palladium) containing catalysts can also be used. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A hydroprocessing process which includes two liquid and one vapor reaction stages and which comprises the steps of:

(a) reacting a feed comprising a hydrocarbonaceous liquid with hydrogen in a cocurrent flow reaction stage in the presence of a hydroprocessing catalyst to form a first stage effluent comprising a mixture of a partially hydroprocessed hydrocarbonaceous liquid and vapor;

(b) separating said liquid and vapor effluent;

(c) reacting said first stage liquid effluent with hydrogen in the presence of a hydroprocessing catalyst in a countercurrent flow hydroprocessing reaction stage to produce a hydroprocessed hydrocarbonaceous product liquid effluent at the bottom of said stage and a hydrocarbonaceous vapor effluent at the top, and (d) combining both of said vapor effluents and then reacting them with hydrogen in the presence of a hydroprocessing catalyst in a vapor hydroprocessing reaction stage to produce a hydroprocessed hydrocarbonaceous vapor, wherein said vapor stage reaction hydrogen is provided by unreacted hydrogen in at least one or both of said countercurrent or cocurrent stage vapor effluents, (e) condensing at least a portion of said hydroprocessed hydrocarbonaceous vapor produced in said vapor hydroprocessing stage to liquid, and then (f) forming a blend consisting essentially of at least a portion of said condensed hydroprocessed hydrocarbonaceous vapor and said hydroprocessed product liquid.

2. A process according to claim 1 wherein said countercurrent and vapor reaction stages are present in a single vessel.

3. A process according to claim 1 wherein said reaction hydrogen for said countercurrent stage is provided by fresh hydrogen or hydrogen-containing treat gas.

4. A process according to claim 1 wherein said cocurrent reaction stage is operated at a pressure higher than said countercurrent and vapor reaction stages.

5. A process according to claim 1 wherein said hydroprocessed vapor contains hydrogen in an amount sufficient to provide at least a portion of the reaction hydrogen for said cocurrent reaction stage.

6. A process according to claim 5 wherein said hydroprocessed vapor contains hydrogen in an amount sufficient to provide all of the reaction hydrogen for said cocurrent reaction stage.

7. A process according to claim 1 wherein said hydrocarbonaceous feed comprises a hydrocarbon liquid.

8. A process according to claim 1 wherein said cocurrent and countercurrent stage vapor effluents contain contaminants which are removed from said feed by said vapor stage hydroprocessing.

9. A process according to claim 1 wherein said countercurrent stage vapor effluent contains hydrogen in an amount sufficient to hydroprocess said combined cocurrent and countercurrent stage vapor effluents.

10. A process for hydrotreating a feed comprising a hydrocarbon liquid which contains heteroatom compounds and unsaturates which comprises the steps of:

(a) reacting said feed with hydrogen in the presence of a hydrotreating catalyst in a cocurrent flow liquid hydrotreating reaction stage to remove more than about 75% of said heteroatom compounds and at least a portion of said unsaturates from said feed to form an effluent comprising partially hydrotreated liquid and a vapor which comprises heteroatom-containing feed components, $H_2S$, $NH_3$ and hydrogen;

(b) separating said liquid and vapor effluent;

(c) reacting said cocurrent stage liquid effluent with hydrogen in the presence of a hydrotreating catalyst in a countercurrent reaction stage in which said liquid and hydrogen flow countercurrently to each other to remove additional heteroatom compounds and unsaturates to produce an effluent comprising a hydrotreated hydrocarbon product liquid and a vapor which comprises heteroatom-containing hydrocarbons, $H_2S$, $NH_3$ and hydrogen;

(d) combining said vapors formed in steps (a) and (c), and then (e) reacting said combined vapors with hydrogen in the presence of a hydrotreating catalyst in a vapor hydrotreating reaction stage to hydrotreat said heteroatom-containing hydrocarbon components in said vapor and form a vapor stage effluent comprising hydrotreated hydrocarbons, $H_2S$, $NH_3$, and hydrogen, and wherein at least a portion of said vapor stage reaction hydrogen is provided by unreacted hydrogen present in said combined cocurrent and countercurrent stage vapor effluents.

11. A process according to claim 10 wherein said vapor stage effluent contains unreacted hydrogen and is cooled to condense at least a portion of said hydrotreated hydrocarbons to liquid, and wherein the liquid is separated from the vapor stage effluent.

12. A process according to claim 11 wherein said uncondensed vapor is treated to remove said $H_2S$ and $NH_3$ to form a hydrogen-rich treat gas which is passed to said cocurrent stage to provide at least a portion of said cocurrent stage reaction hydrogen.

13. A process according to claim 12 wherein fresh hydrogen is introduced into said countercurrent reaction stage to provide all or a portion of the reaction hydrogen for said countercurrent reaction stage.

14. A process according to claim 13 wherein said countercurrent and vapor stages are present in a single vessel.

15. A process according to claim 14 wherein said countercurrent vapor effluent contains hydrogen in an amount sufficient for said vapor stage hydroprocessing.

* * * * *